US005365984A

United States Patent [19]

Simpson et al.

[11] Patent Number: 5,365,984

[45] Date of Patent: Nov. 22, 1994

[54] ELECTRICAL CONNECTOR AND FUEL DISPENSING HOSE WITH ELECTRICAL CONDUIT FOR A FUEL DISPENSING SYSTEM

[75] Inventors: W. Dwain Simpson, Wilton; James H. Pyle, Weston; Geoffrey P. Wilcox, Roxbury, all of Conn.

[73] Assignee: Saber Equipment Corporation, Fairfield, Conn.

[21] Appl. No.: 161,679

[22] Filed: Dec. 2, 1993

Related U.S. Application Data

[63] Continuation-in-part of Ser. No. 986,095, Dec. 4, 1992, Pat. No. 5,267,592.

[51] Int. Cl.[5] ..... B65B 1/04; B65B 3/00

[52] U.S. Cl. ..... 141/387; 141/392; 141/206; 364/509

[58] Field of Search ..... 141/98, 198, 387, 392, 141/206–212; 364/509, 510; 222/71, 74; 439/284, 251, 840, 191, 192, 194, 289; 128/201.19, 202.13, 202.23, 202.27, 911, 912; 285/119; 138/104, 105; 137/351, 360; 340/603, 605, 606, 612, 618

[56] References Cited

U.S. PATENT DOCUMENTS

| | | | |
|---|---|---|---|
| 1,885,227 | 11/1932 | Buchanan | 285/119 |
| 2,821,567 | 1/1958 | Bergan | 285/119 |
| 2,933,333 | 4/1960 | Bredtschneider et al. | 285/119 |
| 3,163,707 | 12/1964 | Darling | 128/204.17 |
| 4,005,412 | 1/1977 | Leander | 340/380 |
| 4,140,013 | 2/1979 | Hunger | 73/229 |
| 5,102,012 | 4/1992 | Foster | 141/59 |
| 5,267,592 | 12/1993 | Kaplan et al. | 141/387 |
| 5,267,670 | 12/1993 | Foster | 141/59 |
| 5,285,744 | 2/1994 | Grantham et al. | 141/392 |

FOREIGN PATENT DOCUMENTS

| | | | |
|---|---|---|---|
| 2174363A | 5/1986 | United Kingdom | B67D 5/22 |
| 2173274 | 10/1986 | United Kingdom | 128/204.17 |

*Primary Examiner*—Henry J. Recla
*Assistant Examiner*—Steven O. Douglas
*Attorney, Agent, or Firm*—Gottlieb, Rackman & Reisman

[57] ABSTRACT

An improved technique for providing electrical power to a fuel dispensing nozzle is disclosed. A fuel dispensing hose is provided with a fluid pathway, a vapor pathway and conductive elements are provided in the vapor pathway for transmitting intrinsically safe electric signals from a fluid dispenser to the fuel dispensing nozzle. A plurality of conductive bands are installed around a portion of the hose, and a plurality of conductive plungers in the fuel dispensing nozzle make contact with the conductive bands. As the fuel dispensing hose is twisted with respect to the nozzle, the conductive bands rotate but nonetheless remain in contact with the conductive plungers, thereby providing uninterrupted electric signals to any desired electronics installed within the fuel dispensing nozzle. On the other end of the hose, a substrate having conductive elements disposed thereon engage an aperture in the input output port of the fuel dispenser. This fragile contact is protected by stabilization bars on the hose that fit into channels of the input output port.

22 Claims, 6 Drawing Sheets

ELECTRICAL CONNECTOR AND FUEL DISPENSING HOSE WITH ELECTRICAL CONDUIT FOR A FUEL DISPENSING SYSTEM

This application is a continuation-in-part application of application Ser. No. 07/986,095 filed Dec. 4, 1992, now U.S. Pat. No. 5,267,592.

BACKGROUND OF THE INVENTION

The present invention relates to an electrical connector and improved dual channel fuel dispensing hose for a fuel dispensing system, and more particularly to an improved hose that carries electrical power and fuel to a fuel dispensing nozzle from the fuel dispenser and carries fuel vapor away from a fuel dispensing nozzle.

In the past several years, workers in the art of fuel dispensing nozzles have attempted to provide electronics, led displays, and basic computer capabilities within the nozzle itself. These attempts have been hampered by the inability to transport the electrical power and signals from the fuel pump to the nozzle.

U.S. Pat. No. 4,005,412, issued to Leander, on Jun. 25, 1977, is an example of a prior art system. In the Leander arrangement, a display is placed atop a nozzle. The display is capable of displaying the amount of fuel dispensed, or other user information. The nozzle is powered by a battery installed therein.

Another example of such a nozzle is described in U.S. Pat. No. 4,140,013, issued to Hunger. In the Hunger patent, the nozzle has an electronic flowmeter, in addition to a display system for displaying data to be read by the user. This patent speaks only generally of power requirements, and suggests using a battery.

Numerous other attempts have been made in the prior art to provide electronics and computer capabilities to a dispensing nozzle. The problem in the prior art is that no safe and efficient way to provide power to the fuel dispensing nozzle exists. Because of the high volatility of fuel being dispensed, it has always been unsafe to provide power supplies in the nozzle, or to run electrical wires to the nozzle. As a result, although numerous patents and prior art publications showing electronics installed into fuel dispensing nozzles exist, none of these have met with commercial success. Regulatory bodies responsible for safety, such as Underwriters Laboratories (UL), have been reluctant to grant approval to fuel dispensing nozzles with unsafe power supplies built in.

Another problem with powering fuel dispensing nozzles is that if the power supply is not built into the nozzle, it must be remotely located and wires run from the remote location, down the fuel dispensing hose, to the nozzle. The problem with this is that the nozzle is often twisted and turned by the user relative to the fuel dispensing hose. Such use presents the danger that the wires will bend too often and eventually fray or electrically short to one another. Due to the volatility of the fuel being dispensed, the situation can become dangerous and explosions may occur.

In view of the desirability of providing user friendly electronics, data input capabilities, and other user friendly items which require electric power in a fuel dispensing nozzle, it can be appreciated from the above discussion that it would be desirable to provide a safe, efficient, and easy to manufacture technique for providing electric power to a fuel dispensing nozzle.

SUMMARY OF THE INVENTION

The above and other problems of the prior art are overcome in accordance with the present invention which relates to an improved technique for providing power to a fuel dispensing nozzle. In accordance with the invention, a fuel dispensing hose includes a first closed pathway for carrying fuel in a first direction and a second closed pathway for carrying vapor in a second opposite direction. Wires or fiber optic material are also provided within the hose for carrying the electric signal between the fuel dispenser and the dispensing nozzle assembly. A connecting collar screws onto the nozzle and connects the nozzle and hose. The electric power is transferred from the hose to the nozzle by a cylindrical member which contains a plurality of conductive bands therearound.

The dispensing hose is connected at one end to the fuel dispenser. At this end, electrical power is transferred from the dispenser to the hose by a male electrical contact on the hose which engages a female electrical contact provided in the input output port of the dispenser. Two stabilizing rods are provided on the hose to lock the hose to the dispenser in stationary engagement. Wires run down the fuel dispensing nozzle from the male contact on the hose to the conductive bands of the cylindrical member on the other end thereof. This transports electrical signals from one end of the hose to the other.

When the cylindrical member is connected to the fuel dispensing nozzle, the conductive bands are placed in contact with conductive plungers on the inside of the fuel dispensing nozzle.

The conductive plungers are resilient and tend to expand out and away from the fuel dispensing nozzle. Due to the resiliency of the conductive plungers, the conductive plungers and conductive bands remain in contact with each other despite variations in the surface or the conductive bands and cylindrical member.

Importantly, the fuel dispensing nozzle can rotate freely without effecting the connection between the conductive bands and the conductive plungers. Thus, the problem with the wires twisting is eliminated.

The conductive plungers are connected through the valve of the fuel dispensing nozzle, to the display system, computer electronics, or other electrical device in the fuel dispensing nozzle. Importantly, the risk of tangled and twisted wires is eliminated as is the need for a power supply in the fuel dispensing nozzle itself. Both of these advantages result in a much safer system which can be exploited commercially, unlike all prior art systems.

DETAILED DESCRIPTION OF THE PREFERRED EMBODIMENT

Figures 1, 10, 11:
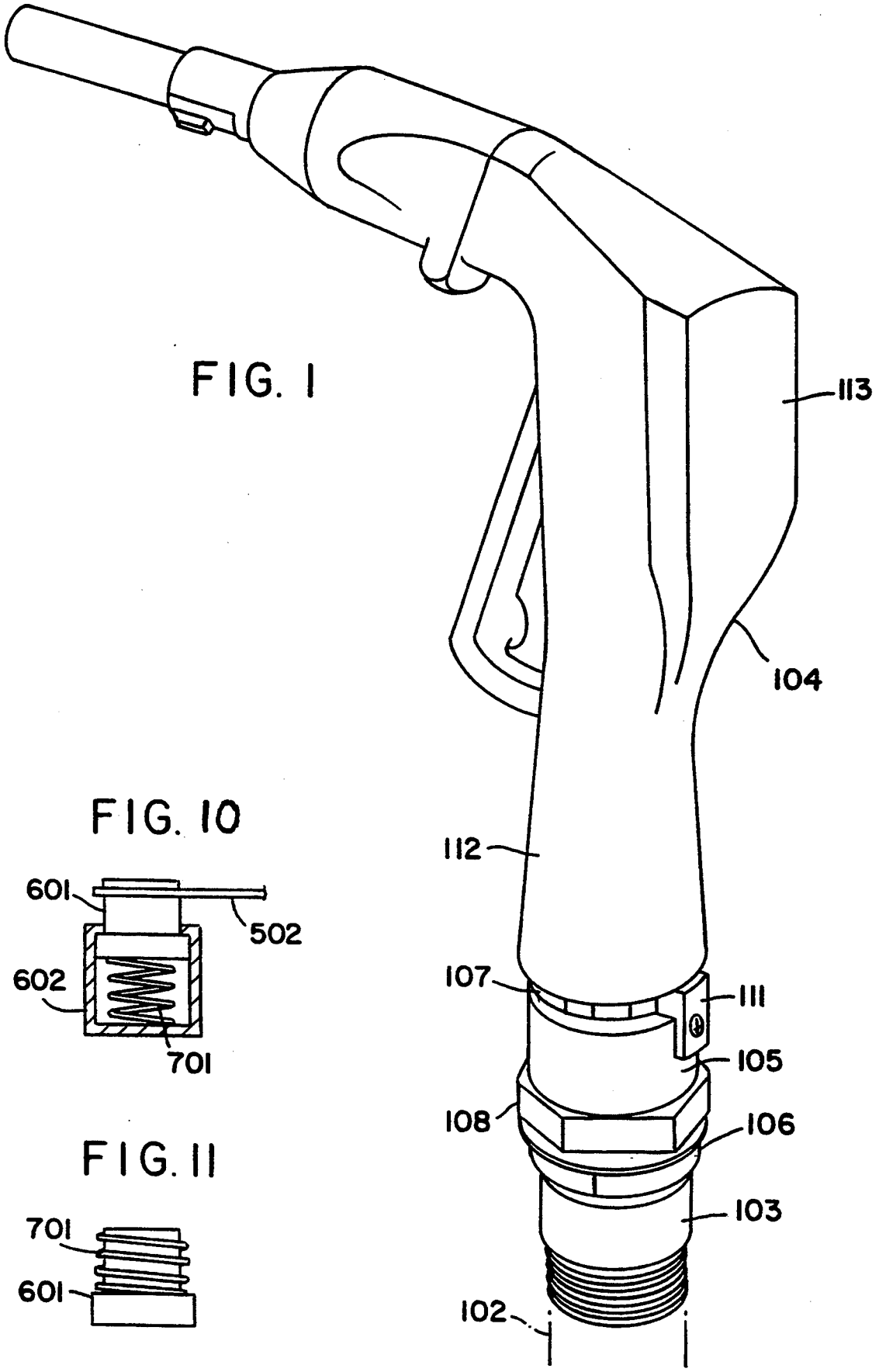
FIG. 1 is a perspective view of a fuel dispensing nozzle with a fuel dispensing hose connected thereto.
FIG. 10 is an enlarged view of the conductive plunger shown in FIG. 8.
FIG. 11 shows an alternative embodiment of the conductive plunger.

FIG. 1 is a perspective view showing a fuel dispensing hose 102 partially connected to fuel dispensing nozzle 104. The nozzle includes a fuel dispensing valve 105 installed therein. Valve 105 is generally cylindrical and is contained within nozzle body 112. The valve is preferably designed to be slidably disengageable from nozzle 104 and is preferably held within nozzle 104 by a breakaway ring 107 as described in the previous application Ser. Nos. 07/931,696 and 08/105,375 assigned to the same assignee as the present application.

The nozzle body 112 includes optional electronics 113 mounted therein. The electrical connector 111 carries electrical power and/or data signals from valve 105 to nozzle 104 as described hereafter. A valve connector portion 108 of valve 105 mates with a connecting collar 106 of hose 102 to connect dispensing hose 102 to nozzle 104. The fuel dispensing hose 102 includes a plastic hose guard 103 at the point where connecting collar 106 meets with valve connector portion 108. The trigger, spout, and other conventional elements of the nozzle 104 are also shown.

Figure 4:
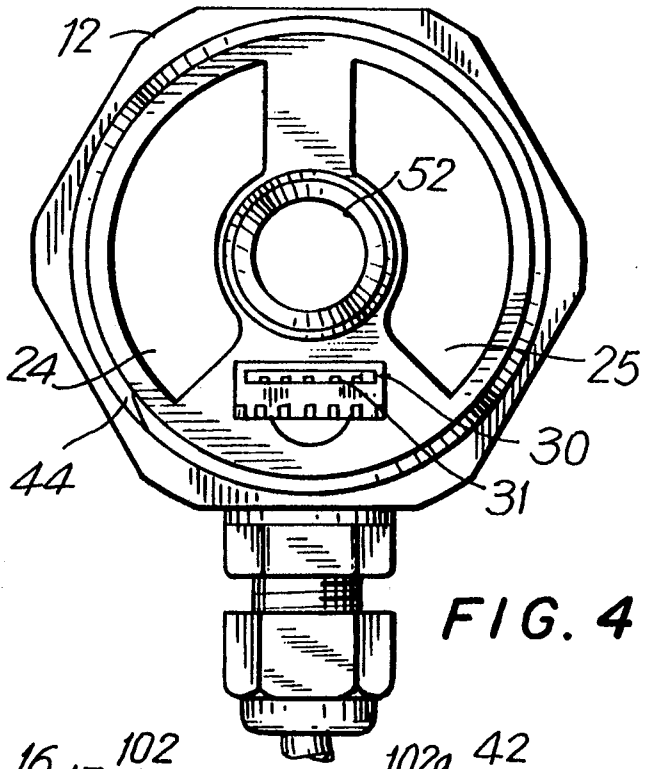
FIG. 4 is an end plan view of the input output port opening of a fuel dispenser.
Figure 2:
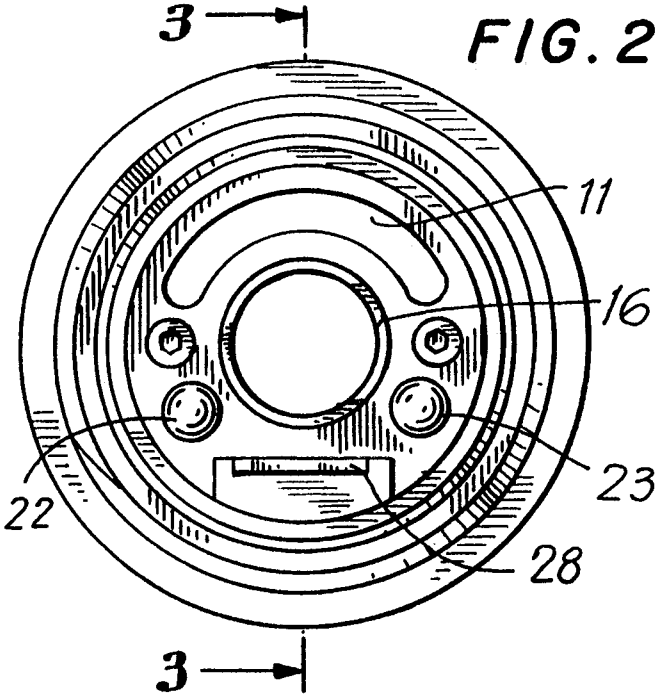
FIG. 2 is an end plan view of the receiving end of a fuel dispensing hose in accordance with the preferred embodiment of the invention.
Figure 3:
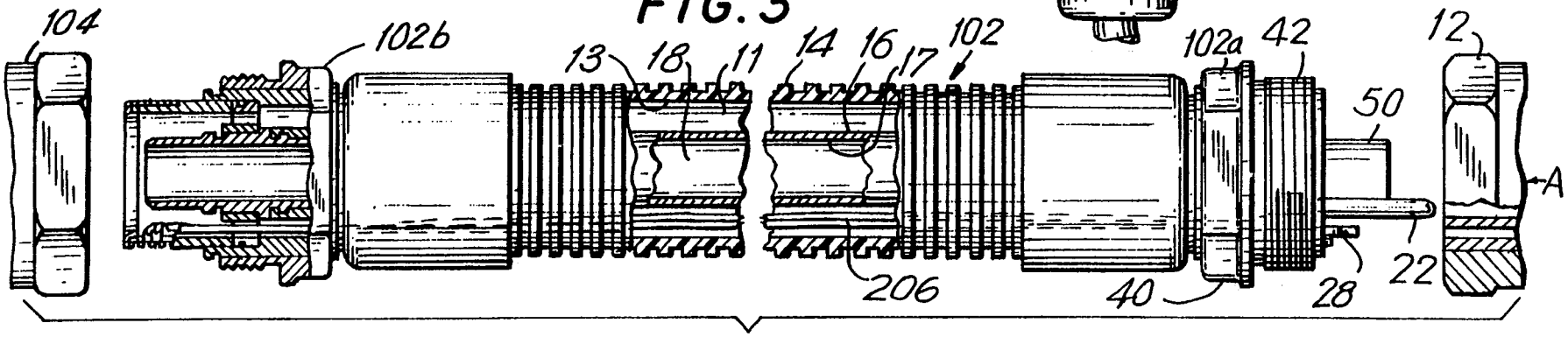
FIG. 3 is a side elevational view of a fuel dispensing hose in partial cross section along lines 3—3 of FIG. 2.

Particular reference is next made to FIGS. 2–4, which illustrate the preferred embodiment of the dual channel hose 102 of the present invention. Hose 102 is connected at a first end **102*a* to an input output port 12 of a fuel dispenser and vapor recovery tank. Hose 102 is connected at a second end 102*b* to fuel dispensing nozzle 104**.

Hose 102 is formed of a first annular outer tube 14 preferably formed of a rubber or plastic type material that is flexible and impermeable to vapor. A second inner tube 16 is also preferably formed of a flexible material that is of a fluid and vapor impermeable substance.

Inner tube 16 includes a continuous inner wall 17 that forms a first pathway 18 to allow fuel to flow from the fuel dispenser to fuel dispensing nozzle 104 in the direction of arrow A. In particular, during engagement with input output port 12 of the dispenser, annular metallic element 50 which is coupled to inner tube 16 engages annular element 52 of input output port 12. In the preferred embodiment, annular element 52 includes at least one gasket therein to create a seal with annular metallic element 50.

A second annular pathway 11 is formed by inner tube 16 and the inner wall 13 of outer tube 14. Second annular pathway 11 carries vapor in a direction opposite to arrow A. In other words, vapor travels from fuel dispensing nozzle 104 to the fuel dispenser. A plurality of conductors 206, such as wires or fiber optic material, are disposed within second annular pathway 11 and electrically couple the fuel dispenser and fuel dispensing nozzle 104.

At first end **102*a*, hose 102 connects to the input output port 12 of the fuel dispenser. Two stabilization bars 22 and 23 are provided to engage slots 24 and 25 of input output port 12. Furthermore, stabilization bars 22 and 23 and slots 24 and 25 help to position male electrical connector 28 within female electrical connector 30. Male electrical connector 28 is formed of a substrate with a plurality of conductive land areas disposed thereon. Each conductive land area is coupled to one of conductors 206. Female electrical connector 30 is formed with a slot 31 to receive male electrical connector 28 therein. Female electrical connector 28 also includes a plurality of leaf spring contacts aligned to bear against the conductive land areas of male connector 28. This relationship allows the electric signals of the fuel dispenser to be coupled with conductors 206 of hose 102**.

It is important to note that when stabilization bars 22 and 23 engage slots 24 and 25, the hose 102 cannot rotate relative to input output port 12 of the fuel dispenser. Therefore, when external threads 42 of the rotatable connecting collar 40 engage the internal threads 44 of input output port 12 of the fuel dispenser, male connector 28 is forced to move linearly into engagement with the female electrical connector 30. If torque is applied to hose 102 relative to input output port 12 of the fuel dispenser, no lateral pressure will be exerted on male and female electrical connectors 28 and 30 because of the engagement of the stabilization bars 22 and 23 engaging slots 24 and 25. If hose 102 is pulled or pressure is exerted thereon in the axial direction relative to the input output port 12 of the fuel dispenser, the pressure or tension is absorbed by rotatable collar 106.

Figure 5:
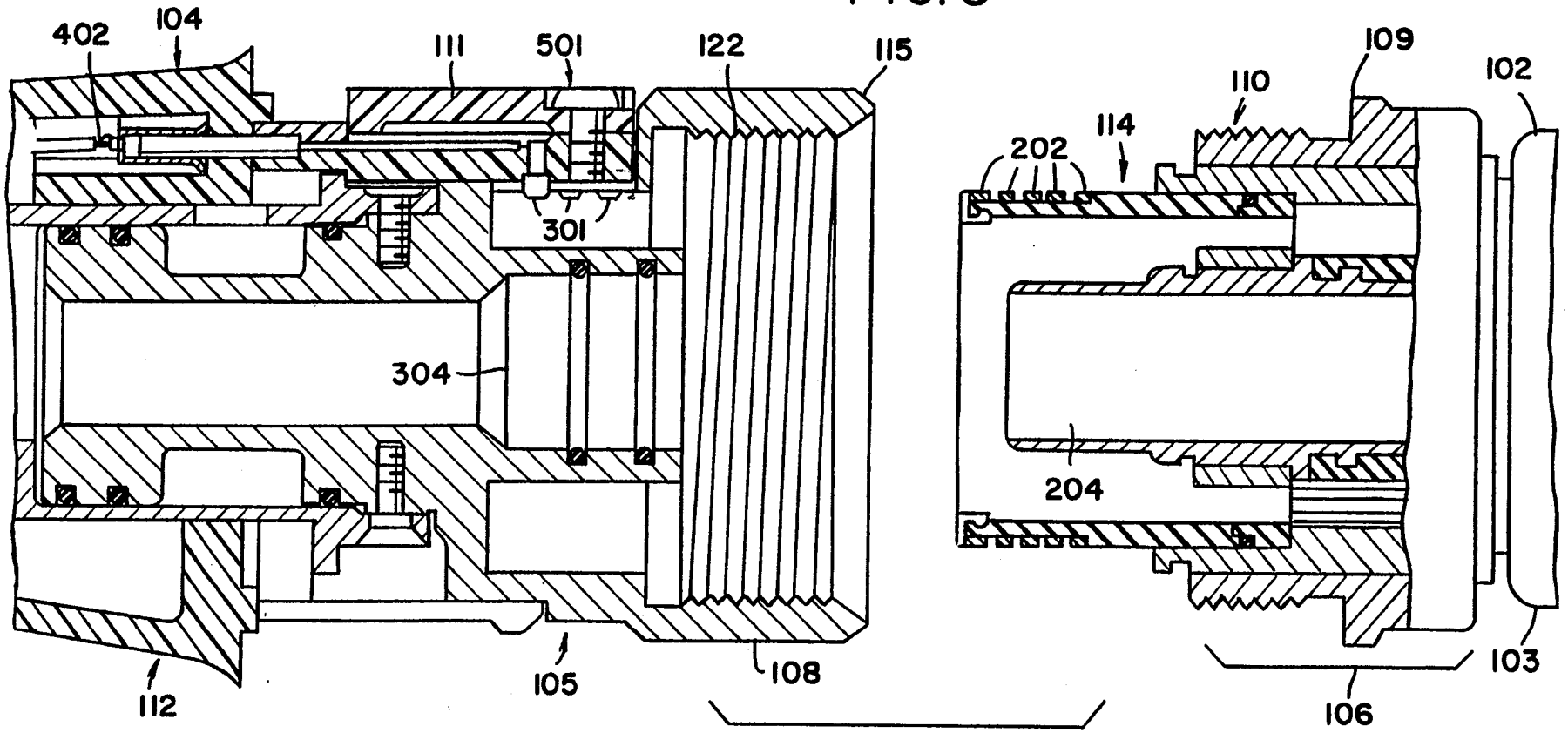
FIG. 5 is an enlarged view of the fuel dispensing hose and nozzle of FIG. 1, showing the portion of the fuel dispensing hose which connects to the fuel dispensing nozzle.

Particular reference is next made to FIGS. 3 and 5 in connection with the coupling of hose 102 at second end **102*b* with fuel dispensing nozzle 104. The figures show nozzle 104 and hose 102 slightly disconnected from each other. Connecting collar 106 includes a threaded portion 110 which, in actual operation, is fully secured to valve connector portion 108 so that flange 109 butts directly up against valve end 115. Mating threads 122 on the inside of valve connector portion 108 connect directly to threaded portion 110**.

Electrical connector 111, more fully described later herein, couples electrical conductors from valve 105 to nozzle body 112. Further electrical conductors 120 may be utilized to run electrical power from the electrical connector 111, through nozzle 104, to electronics 113 which may comprise a display, a data input keypad, or other such device. Additionally, valve control, sensors, and any other electronic or electromechanical devices present in the nozzle may be powered via these electrical conductors. The electronics may, of course, be located anywhere on the nozzle which is convenient or desirable.

The dispensing hose 102 preferably comprises two concentric channels, with inner channel 204 mating with valve channel 304 when the hose and nozzle are connected.

Importantly, connecting collar 106, including threaded portion 110, is free to rotate independent of rotation of dispensing hose 102, hose guard 103, or cylindrical member 114, and is axially constrained by means of a snap ring or other means well known in the art. The hose can be viewed as comprising a rotatable and a stationary part. The rotatable part is connecting collar 106, and the stationary part comprises cylindrical member 114, hose 102 and hose guard 103.

If one were to rotate connecting collar 106, and simultaneously grasp fuel dispensing hose 102, such action would cause hose guard 103 and cylindrical member 114 to be stationary and connecting collar 106 would rotate relative thereto. Furthermore, when collar 106 is assembled and connected to fuel dispensing nozzle 104, fuel dispensing nozzle 104 and collar 106 rotate relative to hose 102. This construction keeps the connecting collar 106 from unscrewing as the hose 102 twists and turns. This is opposite to the top portion of the hose 102*a* of FIG. 3 which is designed not to rotate due to the locking engagement of stabilization bars 22 and 23 relative to slots 24 and 25.

Figure 6:
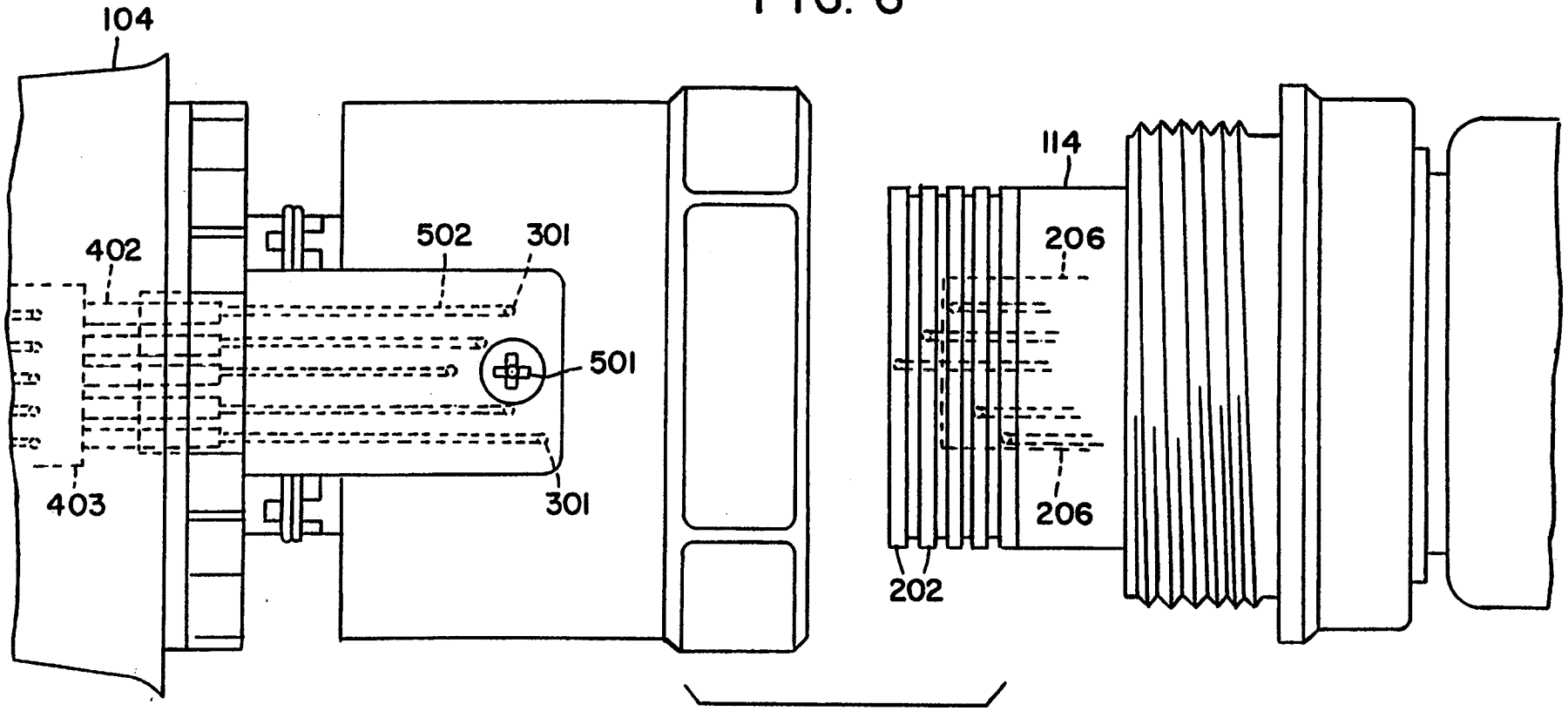
FIG. 6 is a top exploded view of the fuel dispensing nozzle and hose.

FIG. 6 shows a top view of the hose and nozzle disconnected from one another as in FIG. 5. FIGS. 5 and 6 show that cylindrical member 114 also includes a plurality of conductive bands 202 preferably made from copper. The conductive bands run circumferentially around the outside of cylindrical member 114. It is understood that while in this exemplary embodiment conductive bands 202 span the entire outer perimeter of cylindrical member 114, this need not be the case. For example, if rotation of the nozzle 104 relative to hose 102 is limited to less than 360°, then there will be portions of the cylindrical member 114 to which the conductive bands need not be affixed. This is simply a matter of design choice- For example, one way of preventing rotation is to change cylindrical member 114 so that it is not completely cylindrical.

The conductive bands 202 are parallel to one another and each is capable of conducting electricity of sufficient quantity to exchange signals and power with the desired electronics installed in the fuel dispensing nozzle.

Shown in dotted outline in FIG. 6 are conductors 206. Conductors 206 run down the length of fuel dispensing hose 102 from a power supply installed in a remote location. The plurality of conductors 206 are preferably color coded and each terminates inside cylindrical member 114. The power supply should be of an intrinsically safe design and approved for use in a fuel dispensing environment. Techniques for designing such supplies and/or adopting conventional supplies for intrinsic safety are well known in the art.

Each of the conductors 206 is connected to a different one of conductive bands 202 as depicted in FIG. 6. The conductors 206 terminate inside the cylindrical member 114 and a separate small bore 306 is drilled through cylindrical member 114 to connect each conductor 206 from the inside of cylindrical member 114 to its associated conductive band on the outside of cylindrical member 114. The connection is preferably made by including a small conductive stub on the inside of each conductive band 202 which protrudes through the small bore on cylindrical member 114 into the inside of cylindrical member 114.

Figure 7:
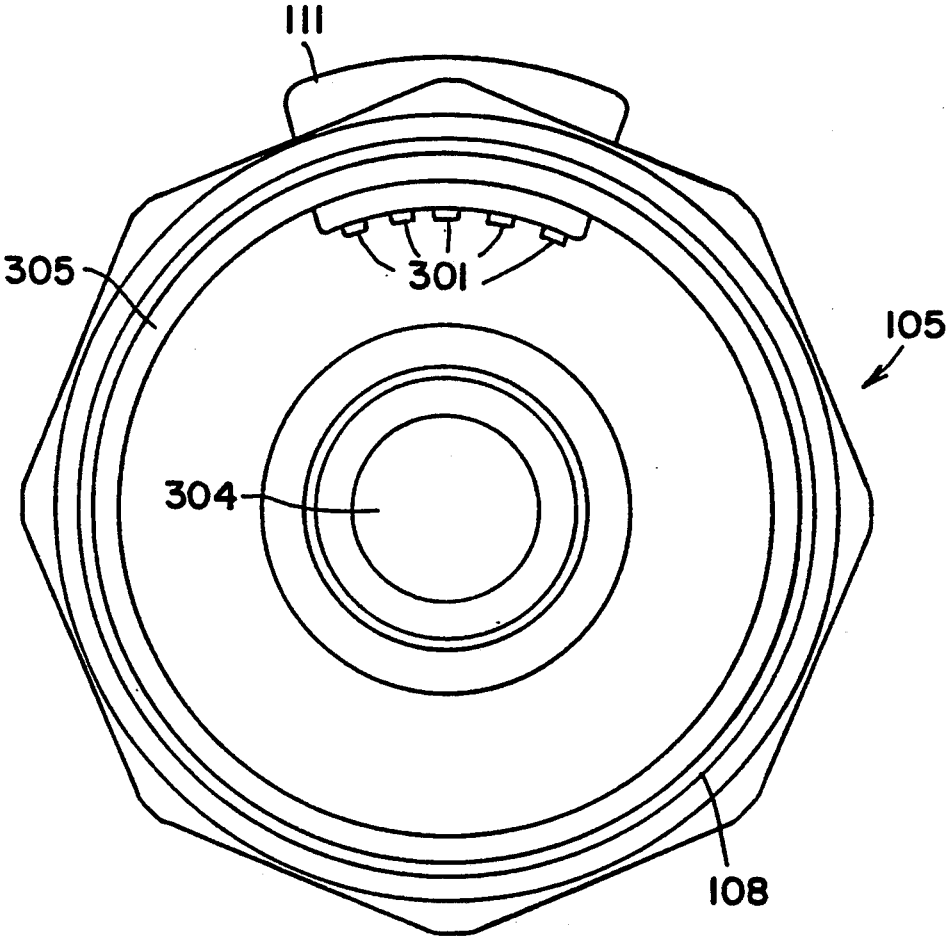
FIG. 7 is a rear view of the fuel dispensing nozzle.

FIG. 7 depicts a rear view of valve 105 looking into the valve with dispensing hose 102 fully removed. Electrical connector 111 is also shown in FIG. 7. Inner valve channel 304 mates with channel 204 from dispensing hose 102. Cylindrical member 114, with its previously described conductive bands 202, would lie between valve channel 304 and the outer surface 305 of valve connector portion 108.

A plurality of conductive plungers 301 emanate from electrical connector 111 as best seen in FIGS. 5 and 6. The particulars of these conductive plungers will be described later herein. The conductive plungers are arranged so that each of them contacts a different one of the conductive bands 202 when the dispensing hose is mated with the fuel dispensing nozzle. The conductive plungers are arranged along electrical connector 111 around screw 501 as best seen in FIG. 6.

Figure 9:
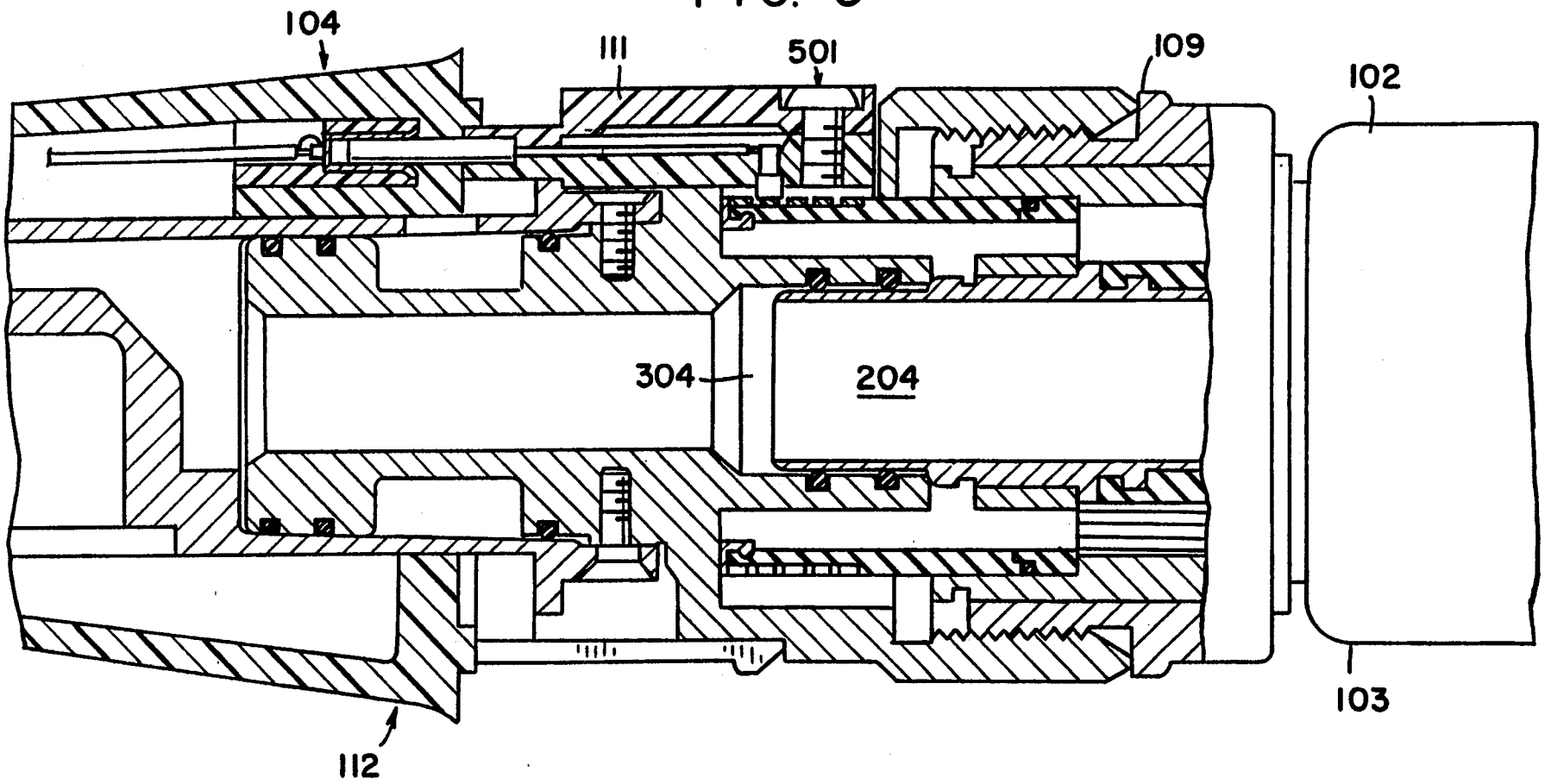
FIG. 9 is a cross-sectional exploded view of the nozzle connected to the hose.

It can be seen from FIGS. 6 and 9 that when the dispensing hose 102 is fully inserted into valve connector portion 108, the electricity and/or electrical signals will be supplied from conductors 206 through conductive bands 202, to conductive plungers 301, and through electrical connector 111 to the dispensing nozzle. The signals may then be transmitted through the dispensing nozzle to the appropriate electronics by a set of conductors 120 installed within the dispensing nozzle.

In the preferred embodiment, electrical connector 111 includes a plurality of stubs 402 which mate with a plurality of sockets 403 in a different connector in dispensing nozzle 104 as shown in FIG. 6. However, it should be noted that once the appropriate power and electrical signals are supplied through electrical connector 111 to dispensing nozzle 104, any appropriate technique can be utilized to run the power and signals to and from the appropriate electronics in the dispensing nozzle 104.

Figure 8:
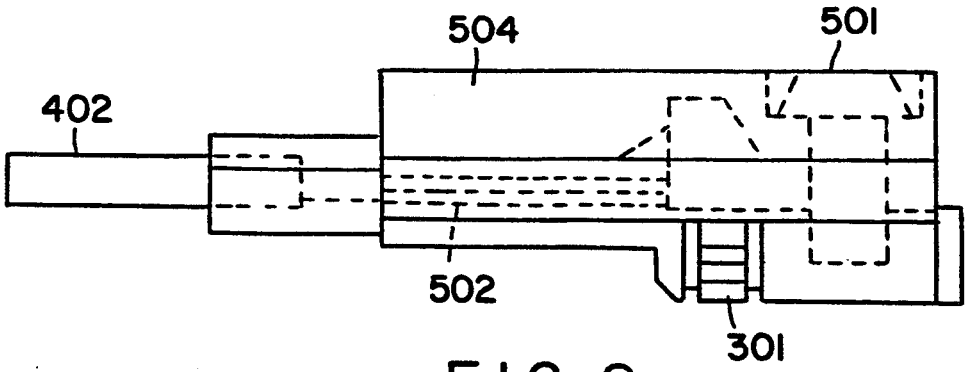
FIG. 8 is an enlarged view of the electrical connector shown in FIG. 7.

An exploded view of electrical connector 111 is shown in FIG. 8. One of stubs 402 is shown as extruding from the connector. As described with reference to the previous figures, these stubs would mate with a socket for supplying power and/or signals to the dispensing nozzle. Stubs 402 are connected to conductive plungers 301 through the connector by means of conductors 502.

The connector 111 is preferably manufactured in two parts with a small screw 501 holding the parts together. This allows the conductive plungers 301, one of which is shown by means of a cutaway in FIG. 8, to be placed in the bottom portion 503 and connected to their respective conductors 502 before the top portion 504 is connected thereto.

The conductive plungers 301 are slightly compressible in length so that as cylindrical member 114 rotates, small variations in the width of conductive bands 202 or cylindrical member 114 itself are compensated for. Moreover, the plungers 301 are spring loaded and thus resiliently tend to expand to their full length. Therefore, contact with conductive bands 202, as shown in FIG. 9, is maintained despite variations in the thickness of the conductive bands, the shape of cylindrical member 114, etc.

An exploded view of a conductive plunger 301 is shown in FIG. 10. An exemplary conductor 502 provides the signal to an upper member 601 which is slidably engaged into a lower member 602. A spring 701 tends to expand the plunger. When the conductive plunger is installed in electrical connector 111, the lower member 602 cannot fit completely out the bottom portion of lower portion 503 of electrical connector 111. Upper member 601 cannot move upward at all since upper portion 504 of electrical connector 111 prevents such movement. Therefore, when the conductive plunger 301 of FIG. 10 is installed properly into an electrical connector 111, it tends to expand, but it cannot fully separate. As cylindrical member 114 rotates, conductive bands 202 press up against conductive plunger 301 and conductive plunger 301 constantly remains in contact with the conductive bands 202. Thus, there is no interruption of power or signals.

FIG. 11 shows an alternative implementation of conductive plunger 301. In the embodiment of FIG. 11, only a single member 601 is utilized, and a spring 701 is utilized in order to force the member outward. The spring pushes against the electrical connector 111 and tends to bias the member 601 and keep it in contact with the conductive bands. The embodiment of FIG. 11 is presently believed to be easier to manufacture.

Returning to FIG. 5, in operation, the dispensing hose 102 is connected to the dispensing nozzle 104 by turning connecting collar 106 clockwise, thereby screwing threaded portion 110 into valve connector portion 108. The inside of valve connector 108 includes the appropriate mating threads 122. When the connecting collar 106 is fully tightened, the arrangement appears as in FIG. 9, with flange 109 touching valve end 115 and each of conductive bands 202 in contact with its associated conductive plunger 301 for purposes of clarity, only one conductive plunger 301 is shown in FIG. 9.

During use, either the dispensing hose 102 or the nozzle 104 will be twisted and turned relative to the other of the dispensing hose 102 and nozzle 104 by service station attendants or self service users. Such turning will cause cylindrical member 114 or plungers 301 to turn. This motion is always relative motion. In other words, the hose 102 moves relative to the nozzle 104 and collar 106, such that the collar 106 will not be unscrewed from nozzle 104. However, as cylindrical member 114 turns the electrical connection between conductive bands 202 and conductive plungers 301 will not be interrupted nor will any wires be twisted because conductive bands 202 span the circumference of cylindrical member of 114 therefore, the conductive bands 202 will remain in contact with their respective conductive plungers 301 as cylindrical member 114 turns.

The above describes the preferred embodiments of the present invention. However, it will be understood that various modifications and/or additions will be apparent to those of ordinary skill in the field. For example, the particular types of electrical connectors or conductors used, and particular channels utilized in order to dispense the fuel, are not critical to the present invention. Nor is the particular nozzle. The conductive plungers may be placed on the inside or outside of the valve connecting portion, or may even be placed elsewhere on the dispensing nozzle if convenient.

Other types of valves and dispensing arrangements may be utilized without the departing from the spirit and scope of the present invention.

What is claimed is:

1. A fuel dispensing system comprising:

a fuel dispensing nozzle having an electrically operated device contained therein;

a fuel dispensing hose in communication between a fuel dispenser and said nozzle, and including a first closed passageway for carrying fuel in a first direction toward said nozzle, a second closed passageway for carrying fuel vapor in a second opposite direction toward said dispenser, and means for carrying a safety-approved electrical signal between said fuel dispenser and said fuel dispensing nozzle in order to selectively provide electronic communication between said electrically operated device and said fuel dispenser, said means being disposed within one of said first and second passageways.

2. The fuel dispensing hose of claim 1, wherein said carrying means includes at least one conductive wire.

3. The fuel dispensing hose of claim 1, wherein said carrying means includes at least one optical fiber.

4. The fuel dispensing hose of claim 1, wherein said fuel dispensing hose includes a coupling member for engagement with said fuel dispenser.

5. The fuel dispensing hose of claim 4, wherein said coupling member rotates independently of said hose.

6. The fuel dispensing hose of claim 1, wherein said hose includes guide means for facilitating engagement with said fuel dispenser.

7. The fuel dispensing hose of claim 4, wherein said coupling member is threaded to facilitate engagement with said fuel dispenser.

8. The fuel dispensing hose of claim 1, wherein said dispensing hose includes an electrical connector for connecting said electrical signal carrying means to the fuel dispensing hose.

9. The fuel dispensing hose of claim 8, wherein said electrical connector for connecting said electrical signal carrying means to the fuel dispensing hose comprising a plurality of conductive elements disposed thereon.

10. The fuel dispensing hose of claim 1, wherein said first closed pathway is a cylindrical inner pathway.

11. The fuel dispensing hose of claim 1, wherein said second closed passageway is an annular passageway concentric about said first closed passageway.

12. The fuel dispensing hose of claim 11, wherein said electrical signal carrying means is located within said annular passageway.

13. The fuel dispensing system of claim 1, wherein said electrical signal carrying means is disposed within said second passageway.

14. An electronic fuel dispensing system comprising:

a fuel dispensing hose with first and second ends having a first closed pathway for carrying fuel, a second closed pathway for carrying recovered fuel vapor and means for carrying an electrical signal through one of said pathways;

a fuel dispensing and vapor recovery tank having an input/output port with an electrical connector;

a fuel dispensing nozzle including means for receiving said electrical signal; and means for connecting said hose first end to said port such that said electrical signal carrying means is in electrical contact with said electrical connector.

15. The fuel dispensing hose of claim 14, wherein said connecting means comprises means for guiding said hose first end into said input/output port.

16. The fuel dispensing hose of claim 15, wherein said guiding means comprises at least one stabilization bar extending from said hose first end, and at least one slot located on the input/output port for selectively receiving said at least one stabilization bar.

17. The fuel dispensing hose of claim 14, wherein said connecting means comprises means for rotatably coupling said hose first end into said input/output port.

18. The fuel dispensing hose of claim 17, wherein said coupling means comprises a rotatable male member on said hose first end selectively engageable in a female member of said input/output port.

19. The fuel dispensing hose of claim 18, wherein said male member rotates independently with respect to said electrical connector.

20. An electronic fuel dispensing system comprising:

a fuel dispensing hose with first and second ends having a first pathway for carrying fuel, a second pathway for carrying recovered fuel vapor, and means for carrying an electrical signal through one of said pathways;

a fuel dispensing and vapor recovery tank having an input/output port with an electrical connector;

at least one stabilization bar extending from one of said hose first end and said input/output port and at least one slot located on the other of said hose first end and said input/output port for selectively receiving said at least one stabilization bar.

21. A fuel dispensing system comprising:

a fuel dispensing hose comprising a first closed passageway for carrying fuel in a first direction, a second closed passageway for carrying fuel vapor in a second opposite direction, and means for carrying an electrical signal therealong and disposed within one of said first and second passageways; and a fuel dispensing nozzle including means for receiving said carried electrical signal.

22. The system of claim 21, wherein said electrical signal receiving means comprises an electrically operated device.

* * * * *